US007963220B2

(12) United States Patent
Sato

(10) Patent No.: US 7,963,220 B2
(45) Date of Patent: Jun. 21, 2011

(54) STENCIL PRINTING APPARATUS

(75) Inventor: Mitsuo Sato, Miyagi (JP)

(73) Assignee: Tohoku Ricoh Co., Ltd, Shibata-gun (JP)

( * ) Notice: Subject to any disclaimer, the term of this patent is extended or adjusted under 35 U.S.C. 154(b) by 661 days.

(21) Appl. No.: 12/019,411

(22) Filed: Jan. 24, 2008

(65) Prior Publication Data

US 2008/0216680 A1 Sep. 11, 2008

(30) Foreign Application Priority Data

Mar. 5, 2007 (JP) ..... 2007-054779

(51) Int. Cl.
*B41L 13/00* (2006.01)

(52) U.S. Cl. ..... 101/118; 101/116

(58) Field of Classification Search ..... 101/114, 101/116, 117, 118, 123, 124, 128.4, 129
See application file for complete search history.

(56) References Cited

U.S. PATENT DOCUMENTS

| | | | | |
|---|---|---|---|---|
| 5,165,338 | A * | 11/1992 | Okazaki et al. | 101/118 |
| 6,371,015 | B1 * | 4/2002 | Tomiya | 101/128.4 |
| 7,441,498 | B2 * | 10/2008 | Iwamoto et al. | 101/119 |
| 2006/0266233 | A1 * | 11/2006 | Nagai | 101/119 |

FOREIGN PATENT DOCUMENTS

| | | |
|---|---|---|
| JP | 4-35188 | 8/1992 |
| JP | 5-64878 | 3/1993 |
| JP | 11-227229 | 8/1999 |
| JP | 2001-130120 | 5/2001 |
| JP | 2001-315291 | 11/2001 |
| JP | 2001-328332 | 11/2001 |
| JP | 2004-351757 | 12/2004 |
| JP | 2005-186357 | 7/2005 |
| JP | 3734247 | 10/2005 |
| JP | 2006-168370 | 6/2006 |
| JP | 2006-281658 | 10/2006 |
| JP | 2006-327023 | 12/2006 |

* cited by examiner

*Primary Examiner* — Ren Yan
(74) *Attorney, Agent, or Firm* — Oblon, Spivak, McClelland, Maier & Neustadt, L.L.P.

(57) ABSTRACT

A stencil printing apparatus in which the generation of discharge sheet peeling problems and defects such as creasing and tear of the stencil base sheet can be prevented while printing on a coated sheet. When a printing sheet set in a sheet-feed device is indicated by input via a sheet-type input device as a coated sheet, or when a printing sheet set in a sheet-feed device is automatically detected by a sheet-type detection device as a coated sheet, a control device judges on the basis of a detected signal from the base-sheet type detection device whether or not the stencil base sheet type set in the platemaking apparatus is for coated sheet printing, and permits platemaking start if the stencil base sheet is for coated sheet printing and issues a warning without permitting platemaking start if the stencil base sheet is for non-coated sheet printing.

5 Claims, 11 Drawing Sheets

FIG. 11

| | | FOR A NORMAL SHEET | FOR A COATED SHEET |
|---|---|---|---|
| STENCIL BASE SHEET ROLL | FILM | STANDARD | ALTERATION TO MATERIAL OF GREATER STRENGTH THAN STANDARD |
| | | | ALTERATION TO LARGER FILM THICKNESS THAN STANDARD |
| | ADHESIVE | STANDARD | ALTERATION TO ADHESIVE OF STRONGER ADHESION THAN STANDARD |
| | SUPPORTING BODY | STANDARD | ALTERATION TO LARGER COATING QUANTITY THAN STANDARD |
| STENCIL PRINTING INK | MATERIAL | STANDARD | ALTERATION TO SYSTEM IN WHICH THE HIGH VISCOSITY COMPONENT IS LESS THAN STANDARD |
| | VISCOSITY | STANDARD | ALTERATION TO VICOSITY LOWER THAN STANDARD |
| | TACK VALUE | STANDARD | ALTERATION TO LOWER TACK VALUE THAN STANDARD |
| PLATEMAKING CONDITIONS | PLATEMAKING PULSE WIDTH | STANDARD | ALTERATION TO LARGER PULSE WIDTH THAN STANDARD |
| | PLATEMAKING FEED SPEED | STANDARD | ALTERATION TO SLOWER PLATEMAKING FEED SPEED THAN STANDARD |
| PRINTING CONDITIONS | PRINTING PRESSURE VALUE | STANDARD | ALTERATION TO LOWER PRINTING PRESSURE VALUE THAN STANDARD |

FIG. 12

| | STANDARD MASTER | | HIGH-STRENGTH MASTER | |
|---|---|---|---|---|
| | STANDARD INK | LOW-COHESION INK | STANDARD INK | LOW-COHESION INK |
| COATING SHEET | × | Δ | Δ | O |
| NON-COATING SHEET | O | Δ | – | – |

STENCIL PRINTING APPARATUS

BACKGROUND OF THE INVENTION

1. Field of the Invention

The present invention relates to a stencil printing apparatus that performs printing using a stencil base sheet (hereinafter referred to also as a "master") in which perforations are created by platemaking in accordance with the image data of an original mounted on the outer circumferential surface of a plate cylinder, and more particularly to a stencil printing apparatus capable of performing printing on a coated sheet.

2. Description of the Related Art

Stencil printing apparatuses that comprise a stencil platemaking device (hereinafter referred to simply as a "platemaking" device) for perforating a large number of independent holes in a master using a thermal head to manufacture a master plate, a cylindrical plate cylinder on the outer circumference of which the master made by platemaking is windingly mounted and which is rotationally driven around its axis, an ink supply device provided in the plate cylinder for supplying ink to the inner surface of the plate cylinder, a sheet-feed device for separately feeding out printing sheets, a printing-pressure device for pressing the fed printing sheets onto the outer circumferential surface of the aforementioned plate cylinder, and a discharge device for conveying and discharging the printed sheets, and that employ a system for forming a printed image based on ink having passed through the perforations made by platemaking in the master being transferred onto the printing sheet are already widely known.

The large number of independent holes formed by the platemaking device are produced as a result of the perforation of a thermoplastic resin film of the master based on selective heating thereof by very small heat-emitting bodies of a thermal head in accordance with image information. Ink that passes through the perforations formed in the master is directly transferred onto the surface of the printing sheet to form a printed image.

In addition, predetermined printing images are formed using this kind of stencil printing apparatus as a result of printing sheets (sheet-like recording medium) separated into individual sheets and conveyed by a sheet-feed portion being pressed, while being conveyed, by the printing-pressure device onto the outer circumferential surface of a printing drum on the outer circumferential surface of which a master manufactured by platemaking is windingly mounted so that ink passing through the perforations of the master is selectively transferred onto the printing sheet surface.

The essential conditions required of sheets used in conventional stencil printing apparatuses are a surface of large undulations and ink permeability. This is because the drying system employed in these apparatuses is based on permeation into the sheet. That is to say, rather than natural drying, a system of pseudo-drying the ink transferred onto a sheet based on permeation thereof between the fibers of the sheet and evaporation of the liquid phase of the ink is fabricated.

Accordingly, the surface of the sheet pressed onto the surface film of the master windingly mounted onto the outer circumference of the printing drum possesses a certain degree of undulations between which an air layer exists.

By virtue of this, and the resilient strength of the sheet, a printing sheet can be comparatively easily peeled from the outer circumferential surface of the printing drum immediately following printing by a powerful sheet discharge peeling means. Furthermore, even if the number of printed copies printed using a single master is of the order of 5000 copies and a slight amount of stretch of the master itself has occurred, non-permissible level of creasing and tear will not be generated.

Printing using a stencil printing apparatus employing a master used in a platemaking device such as this on a so-called coated sheet on which a coating has been administered on the surface thereof has hitherto hardly even been implemented because it has conventionally been regarded as impossible.

However, there has been a long-held demand in the Japanese domestic market for printing to be able to be performed on a coated sheet. This is because the method employed by manufacturers for the bulk printing of, for example, flyers has concentrated on printing by offset color printing and has involved the flyers being distributed to regional branch shops, and the branch shops printing additional shop map and independent information on a partial blank area of the flyers and distributing them to individual households.

While in this case a lightweight coated sheet is employed as the optimum sheet for offset color printing and, as the optimum printer for the additional printing performed at each branch shop an inexpensive and simple digital platemaking stencil printer able to be used by anyone anytime is employed, regrettably, ink is unable to be used with a coated sheet because it does not dry and fix thereto.

However, stencil printing employing a UV ray-curable ink is already widely known and, if this system is employed, the ink of a printed image can be dried and cured on even non-permeable sheets, and the stencil printing on the aforementioned coated sheet is regarded as being able to be readily performed.

Known UV ray-curable ink-employing stencil printing apparatuses are described in Japanese Utility Model Publication No. 4-35188 and Japanese Unexamined Patent Application No. H5-64878.

In addition, Japanese Unexamined Patent Application No. 2006-327023 discloses, in a stencil printing apparatus in which both a UV ray-curable ink and a non-UV ray-curable ink, ink attached to a drum being detected as either a UV ray-curable ink or a non-UV ray-curable ink, and a warning being issued when an incompatibility exists. This application similarly discloses a master mounted on a platemaking device being detected as a master suitable for UV ray curing or a master suitable for non-UV ray curing, and a warning being issued when an incompatibility exists.

In addition, Japanese Unexamined Patent Application No. 2004-351757 discloses a configuration in which a permeable drying ink and a UV ray-curable ink are selected by switching a supply valve, and which employs a UV ray-curable ink for printing on a coated sheet.

In addition, Japanese Unexamined Patent Application Nos. H11-227229 and 2006-168370 disclose, in an ink jet system, detection of a recording medium material type and judgment of whether a first ink or a second ink is to be used in accordance therewith.

In addition, Japanese Unexamined Patent Application No. 2001-130120 discloses, in a stencil printing apparatus, a configuration in which two types of master are supported of which one is selectively used in accordance with the printing sheet type.

In addition, Japanese Unexamined Patent Application No. 2001-315291 discloses, in a stencil printing apparatus, the adjustment of platemaking energy in accordance with the printing sheet type.

In addition, Japanese Unexamined Patent Application No. 2001-328332 discloses, in a stencil printing apparatus, automatic selection of printing conditions in accordance with the printing sheet type.

In addition, Japanese Unexamined Patent Application No. 2005-186357 discloses selection of ink jet recording conditions based on a discrimination result of sheet type, and the issue of a warning when an incompatibility exists.

In addition, Japanese Unexamined Patent Application No. 2006-281658 discloses, in a stencil printing apparatus, control of UV lamp flashing according to the use of a UV ink drum unit or a non-UV ink drum unit.

In addition, Japanese Patent No. 3734247 discloses the discrimination of a coated sheet based on optical detection.

Repeated implementation of printing tests on coated sheets employing a conventional stencil printing apparatus carried out by the inventor of the present invention with a view to understanding the merits and problems inherent thereto led to an awareness of additional new problems.

In stencil printing, a large number of very small perforations are provided by a platemaking process in the film surface of a master windingly mounted on the outer circumference of a printing drum, and ink passing through these perforations is pressed onto the printing sheet by a printing pressure portion and transferred on to the printing sheet surface to form a printed image.

At this time, ink is interposed and perfectly closely adhered between the film surface of the master and the surface of the printing sheet. For a coated sheet, because the smoothness of the sheet surface thereof is immeasurably greater than the smoothness of a conventional normal sheet, this adherence force is very large. While the printing sheet is subsequently peeled from the printing drum and discharged, because the printing sheet sticks to the printing drum due to the adhesive strength of the ink, a very large peeling force is required at this time.

For a conventional normal sheet, because of its air permeability and the large undulations in the surface thereof, it can be peeled from the printing drum with a moderate level of peeling force. In addition, using a conventional emulsion ink, because both the adhesive strength and the tack value of the ink itself are very low and the ink cohesion force is also low, the ink tears easily and the printing sheet can be peeled off with a moderate level of force.

However, these conditions are significantly different when the printing sheet is a coated sheet. That is to say, because the surface smoothness of a coated sheet is very high and the sheet sticks to the printing drum due to the adhesive strength of the ink, a markedly greater force is required to peel the sheet from the surface of the master film of the outer circumference of the printing drum because. As a result, it was clear that the master film rather than the sheet was lacking in resistance, and that slippage thereof resulting in creasing and tear thereof sometimes occurred.

It was also apparent that a switch of the printing ink from a conventional emulsion inks to a UV ray-curable inks of which the principal component is a monomer led to an increase in the adhesion strength and tack value of the ink itself and, in turn, to a magnification of the drawbacks described above.

As the master film, a very thin film configured from a thermoplastic synthetic resin of which the thickness thereof allows for the manufacture therein of perforations by platemaking at high speed using a thermal head is used. More specifically, a PET film of thickness of the order of 1.5 to 2 microns is used. A marked drop in strength occurs in the solid image portion in which a large number of perforations are formed by platemaking in this very thin film and, as a result, it separates and creases and tears easily due to the peeling performed immediately following printing.

SUMMARY OF THE INVENTION

With a resolution to the problems inherent to performing stencil printing on a coated sheet in mind, it is an object of the present invention to prevent the generation of discharge sheet peeling problems and defects in the stencil base sheet such as creasing and tear of the stencil base sheet when printing on a coated sheet by employing a stencil base sheet and ink different to the stencil base sheet and ink use with a non-coated paper.

In an aspect of the present invention, a stencil printing apparatus has a platemaking device that creates perforations in a stencil base sheet via platemaking means, a rotationally-driven cylindrical plate cylinder on an outer circumferential surface of which a stencil base sheet made by platemaking is mounted, a sheet-feed device for separately feeding out a printing sheet, a printing-pressure device for pressing a fed printing sheet onto the outer circumferential surface of the plate cylinder, and a sheet discharge device for conveying and discharging a printed sheet. The stencil printing apparatus comprises at least one of either a sheet-type input device for inputting whether a printing sheet set in the sheet-feed device is a coated sheet or a non-coated sheet, or a sheet-type detection device for automatically detecting whether a printing sheet set in the sheet-feed device is a coated sheet or a non-coated sheet; a base-sheet type detection device for detecting a type of the stencil base sheet set in the platemaking device, and a control device for, when a sheet type indicated by input via the sheet-type input device or a sheet type detected via the sheet-type detection device is a coated sheet, executing a control for judging whether or not a type of stencil base sheet set in the platemaking device is for coated sheet printing on the basis of a detected signal from the sheet-type detection device, and permitting platemaking start when the stencil base sheet type is for coated sheet printing and issuing a warning without permitting platemaking start when the stencil base sheet type is for non-coated sheet printing.

In another aspect of the present invention, a stencil printing apparatus has a rotationally-driven cylindrical plate cylinder on an outer circumferential surface of which a stencil base sheet made by platemaking is mounted, an ink supply device for supplying printing ink to the plate cylinder, a sheet-feed device for separately feeding out a printing sheet, a printing-pressure device for pressing a fed printing sheet onto the outer circumferential surface of the plate cylinder, and a sheet discharge device for conveying and discharging a printed sheet. The stencil printing apparatus comprises at least one of either a sheet-type input device for inputting whether a printing sheet set in the sheet-feed device is a coated sheet or a non-coated sheet, or a sheet-type detection device for automatically detection whether a printing sheet set in the sheet-feed device is a coated sheet or a non-coated sheet; an ink-type detection device for detecting a type of printing ink set in the ink supply device; and a control device for, when a sheet type indicated by input via the sheet-type input device or a sheet type detected via the sheet-type detection device is a coated sheet, executing a control for judging whether or not a type of printing ink set in the ink supply device is for coated sheet printing on the basis of a detected signal from the ink-type detection device, and permitting platemaking start or printing start when the printing ink type is for coated sheet printing and issuing a warning without permitting platemaking start or printing start when the printing ink type is for non-coated sheet printing.

In another aspect of the present invention, a stencil printing apparatus has a sheet-feed device for separately feeding out a printing sheet, a rotationally-driven cylindrical plate cylinder on an outer circumferential surface of which a stencil base sheet made by platemaking is mounted, an ink supply device for supplying printing ink to the plate cylinder, and a printing drum unit which comprises an ink container holding portion for holding detachably an ink container that houses printing ink and in which the plate cylinder and the ink supply device are integrally provided, the printing drum being supported detachably on a printing device main body. The stencil printing apparatus comprises a drum-type detection device for detecting whether or not the printing drum unit mounted on the printing device main body is a drum unit for coated sheet printing or a drum unit for non-coated sheet printing; at least one of either a sheet-type input device for inputting whether a printing sheet set in the sheet-feed device is a coated sheet or a non-coated sheet, or a sheet-type detection device for automatically detecting whether a printing sheet set in the sheet-feed device is a coated sheet or a non-coated sheet; and a control device for, when a sheet type indicated by input via the sheet-type input device or a sheet type detected via the sheet-type detection device is a coated sheet, executing a control for judging whether or not a drum unit mounted on the printing device main body is for coated sheet printing on the basis of a detected signal from the drum-type detection device, and permitting platemaking start or printing start when the drum unit is for coated sheet printing and issuing a warning without permitting platemaking start or printing start when the drum unit is for non-coated sheet printing.

In another aspect of the present invention, a stencil printing apparatus has a sheet-feed device for separately feeding out a printing sheet, a rotationally-driven cylindrical plate cylinder on an outer circumferential surface of which a stencil base sheet made by platemaking is mounted, an ink supply device for supplying printing ink to the plate cylinder, and a printing drum unit which comprises an ink container holding portion for holding detachably an ink container that houses printing ink, and in which the plate cylinder and the ink supply device are integrally provided, the printing drum being detachably supported on a printing device main body. The stencil printing apparatus comprises a drum-type detection device for detecting whether or not the printing drum unit mounted on the printing device main body is a drum unit for coated sheet printing or a drum unit for non-coated sheet printing; an ink container-type detection device for detecting whether the ink container mounted on the ink container holding portion is an ink container for coated sheet printing or an ink container for non-coated sheet printing; at least one of either a sheet-type input device for inputting whether a printing sheet set in the sheet-feed device is a coated sheet or a non-coated sheet, or sheet-type detection device for automatically detecting whether a printing sheet set in the sheet-feed device is a coated sheet or a non-coated sheet; and a control device for, when a sheet type designated by input via the sheet-type input device or a sheet type detected via the sheet-type detection device is a coated sheet, executing a control for judging on the basis of a detected signal from the drum-type detection device and the ink container-type detection device whether or not a printing drum unit mounted on the printing device main body is a drum unit for coated paper printing and whether or not an ink container mounted on the ink container holding portion is an ink container for coated paper printing, and permitting platemaking start or printing start when both the drum unit and ink container are for coated sheet printing and issuing a warning without permitting platemaking start or printing start when either the drum unit or the ink container, or both are for non-coated sheet printing.

BRIEF DESCRIPTION OF THE DRAWINGS

The above and other objects, features and advantages of the present invention will become more apparent from the following detailed description taking with the accompanying drawings in which:

FIG. 11 is a table showing differences between the printing conditions for a coated sheet and a non-coated sheet (plain paper); and FIG. 12 is a table showing the relationship between ink viscosity and master strength for a coated sheet and a non-coated sheet.

DESCRIPTION OF THE PREFERRED EMBODIMENTS

An embodiment of the present invention will be hereinafter described with reference to FIG. 1 to FIG. 10B.

Figure 1:
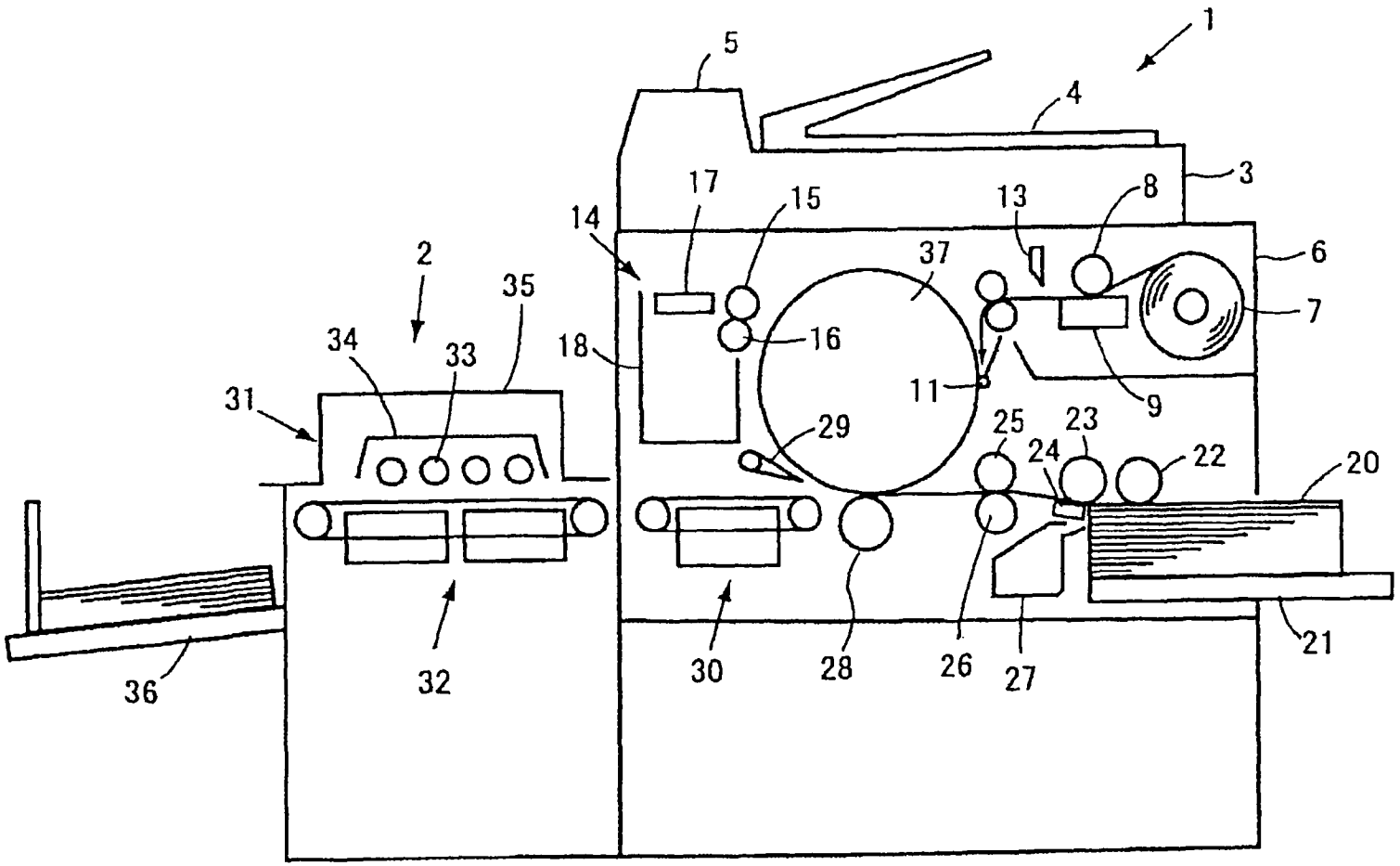
FIG. 1 is a diagram that schematically shows a configuration of a stencil printing apparatus pertaining to one embodiment of the present invention.

First, the overall configuration and printing operation of a stencil printing apparatus pertaining to the embodiment will be described in summary with reference to FIG. 1.

The stencil printing apparatus is configured from a printing device main body 1, and a UV-ray irradiation device 2 detachably connected to the sheet discharge-side face of the printing device main body 1.

The symbol 3 denotes a scanner portion for reading an image of an original that comprises on its upper surface an openable/closeable pressing plate 4, and further comprises an ADF portion 5 for automatically feeding a plurality of originals in succession.

The symbol 6 denotes a platemaking device comprising a platemaking and a plate-feeding function, a master 7 thereof wound in a roll shape being conveyed and manufactured into a perforated plate while being pressed by a platen roller 8 against a thermal head 9 serving as platemaking means. The master 7 is replaceable from the exterior.

A leading-end portion of the platemaking manufactured master 7 obtained is clampedly held by a master clamp 11 provided in the outer circumferential surface of a cylindrical plate cylinder 37 and wound around the outer circumference of the plate cylinder 37 before being cut by a cutter 13 into predetermined lengths. The symbol 14 denotes a plate discharge device for separating and conveying used masters from the outer circumference of the plate cylinder 37 and housing the same. The plate discharge device 14 comprises plate discharge rollers 15, 16 for separating and conveying the masters, a pressure plate 17 for pressing down onto these plates, and a plate discharge housing box 18 for housing the discharged plates.

Printing sheets 20 are successively separated into individual sheets from a sheet-feed tray 21 by a separation roller 23 and a separation pad 24 while subjected to a conveying force from a sheet-feed roller 22, and are delivered to a printing portion (pressure contact portion between the plate cylinder 37 and a press roller 28) at a set timing by a pair of resist rollers 25, 26 provided downstream in the direction of sheet feed.

Here, to ensure reliable separation when coated sheets are being fed, an air blowout device 27 that aids in separation by blowing air onto the sheets from the front side in the direction of sheet feed, as well as from the lateral direction thereto, is provided.

The sheet-feed device is configured from the sheet-feed tray 21, the sheet-feed roller 22, the separation roller 23, the separation pad 24, and the air blowout device 27 and so on.

The symbol 28 denotes a press roller serving as one element of a printing pressure device that presses a printing sheet onto the plate cylinder 37 to effect the formation of images thereon, the pressing operation of the press roller 28 being controlled by a separate drive source.

The symbol 29 denotes a separation hook for separating printing sheets from the plate cylinder 37, and the symbol 30 denotes a conveyor belt device serving as a sheet discharge device to which sheets printed on the plate cylinder 37 are suctionally conveyed.

The printing sheet on which an ink image has been transferred from the plate cylinder 37 to form an image is conveyed toward the UV-ray irradiation device 2 connected to the downstream side of the conveyor belt device 30 in the direction in which the printed sheets are conveyed. The printing ink supplied to the plate cylinder 37 is a UV ray-curable ink.

The UV-ray irradiation device 2 is configured from a UV-ray irradiation unit 31 and a printed matter conveying unit 32, and is mechanically connected to the sheet discharge-side of the printing device main body 1.

The UV-ray irradiation unit 31 is provided above the printed matter conveying unit 32 and comprises a UV-ray lamp 33 such as a high-pressure mercury lamp or metal halide lamp, a reflection plate 34 formed from an alumina plate or the like, and a cover casing 35 provided on the outer side of the reflection plate 34.

In addition, while not shown in the diagram, in order to suction air into the cover casing 35 and discharge the air outside the printing device subsequent to the air having being passed through an ozone filter, an air exhaust pipe or suction fan or similar is provided. Fixed printed matter is discharged to and accumulated in a sheet discharge tray 36.

Figure 2:
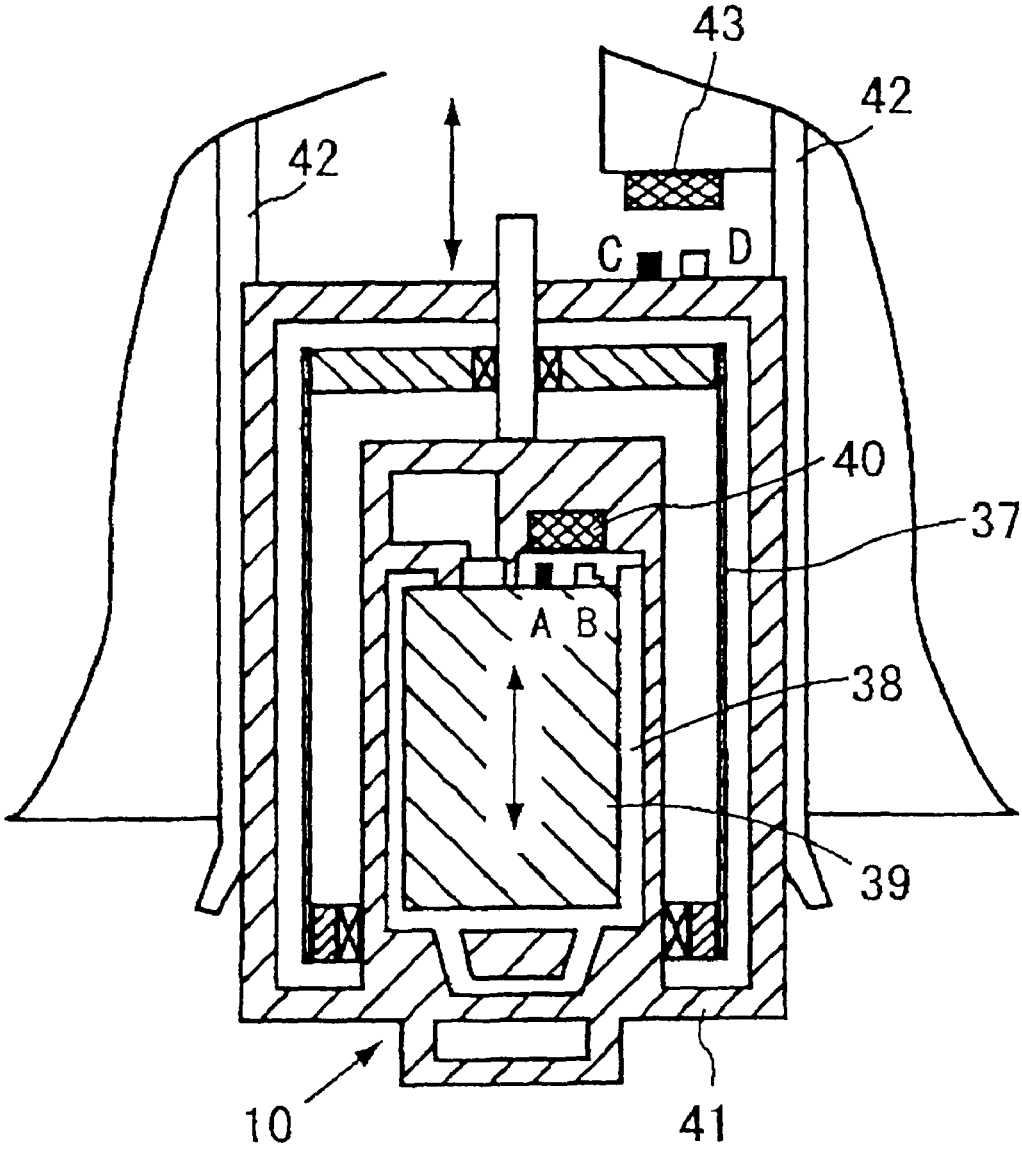
FIG. 2 is a horizontal cross-sectional view of a printing drum unit of the stencil printing apparatus.

FIG. 2 shows a configuration of a printing drum unit 10 in which the plate cylinder 37 is integrally provided. FIG. 1 shows the plate cylinder 37 only, and the remaining configuration of the drum unit has been omitted.

An ink container cradle 38 provided in the interior of the plate cylinder 37 as an ink container holding portion is slidable in the direction of the arrow in the diagram while supporting the ink container 39, the ink container 39 being detachably replaceable from the exterior.

Ink container-type detection means 40 for detecting (identifying) the type of ink container 39 subsequent to the ink container cradle 38 being established in its proper mounted position is provided on the printing drum unit 10 side thereof. The ink container 39 itself also comprises a protrusion A in which coated sheet printing ink is housed, and a protrusion B in which non-coated sheet printing ink is housed.

Ink container-type detection means 40 is designed to be able to detect whether the protrusion is A or B. Ink container-type detection means 40 may also serve as ink-type detection means.

The printing drum unit 10 comprises a drum frame 41 for rotatably supporting the plate cylinder 37, and is detachably configured with respect to the printing device main body 1 to slide in the direction of the arrow of the diagram along a guide rail 42 of the printing device main body 1.

Drum unit type detection means 43 for identifying the type of printing drum unit 10 subsequent to the drum frame 41 being established in its proper mounted position is provided on the printing device main body side.

The printing drum unit 10 comprises a protrusion C for a coated sheet printing drum unit, and a protrusion D for a non-coated sheet printing drum unit. Drum unit type detection means 43 is designed to be able to detect if the protrusion is C or D.

Figure 3:
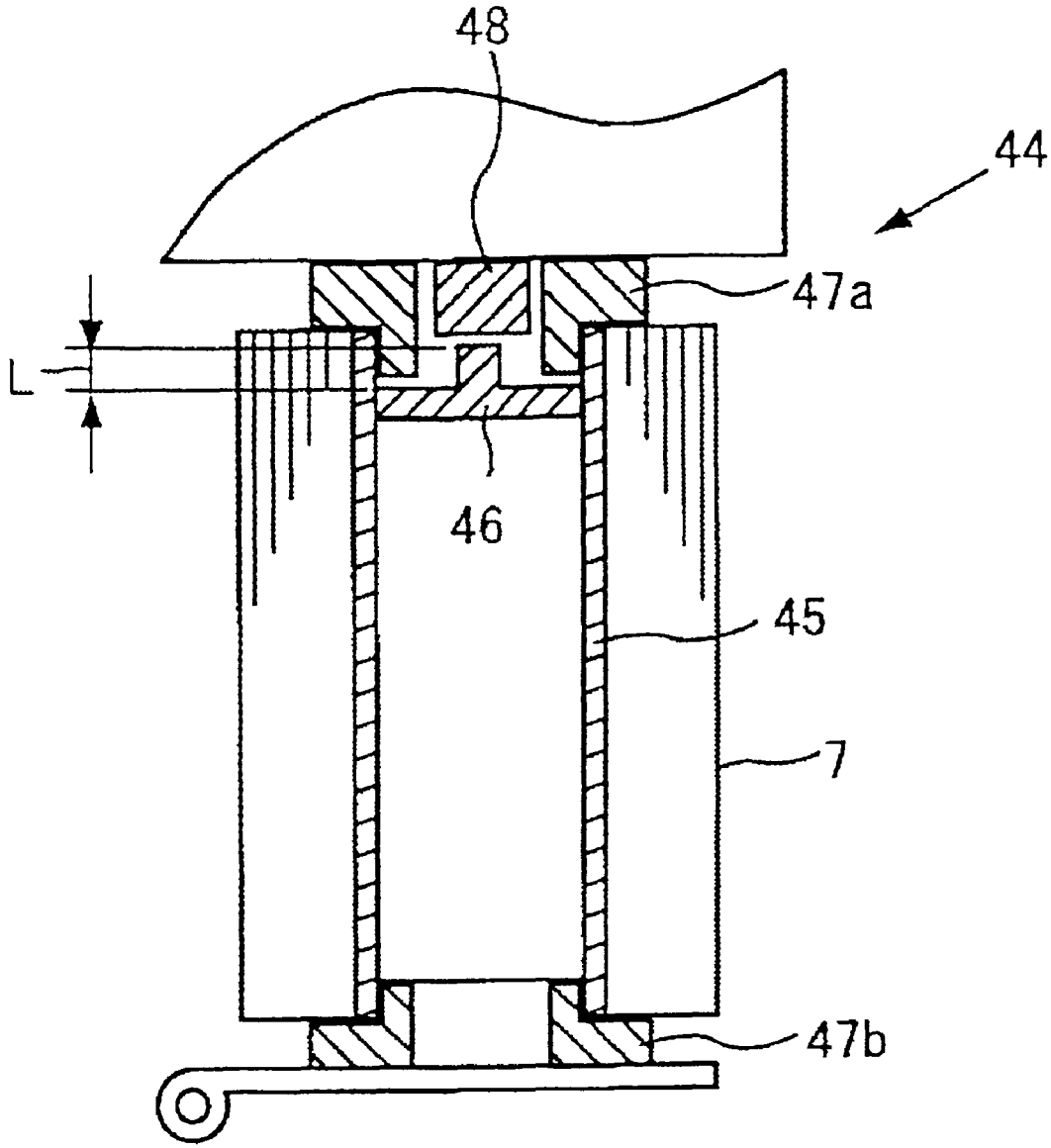
FIG. 3 is a horizontal cross-sectional view of a structure of a master roll mounting portion of a platemaking device of the stencil printing apparatus.

FIG. 3 shows the structure of a master roll mounting portion 44 of the platemaking device 6.

While the master roll 7 is established in a mode in which a long master is wound in a rolled shape around the circumference of a cylindrical sheet core 45, an identifying member 46 comprising a protrusion is mounted on one end side of this sheet core 45. A length dimension L of the protrusion of the identifying member 46 is set longer for a coated sheet printing master and shorter for a non-coated sheet printing master.

Master roll supporting members 47*a*, 47*b* are provided in the platemaking device main body side for rotatably supporting the sheet core 45 of the master 7 from the left and right, base sheet detection means 48 for detecting the length of the protrusion of the identifying member 46 being provided on the master roll supporting members 47*a* side. Base sheet detection means 48 is designed to be able to detect and identify whether the mounted master 7 is a coated sheet printing master roll or instead is a non-coated sheet printing master roll.

FIG. 11 shows the differences in the stencil printing apparatus conditions pertaining to this embodiment between when the printing sheet is a coated sheet and when it is a non-coated sheet (normal sheet).

Figure 4:
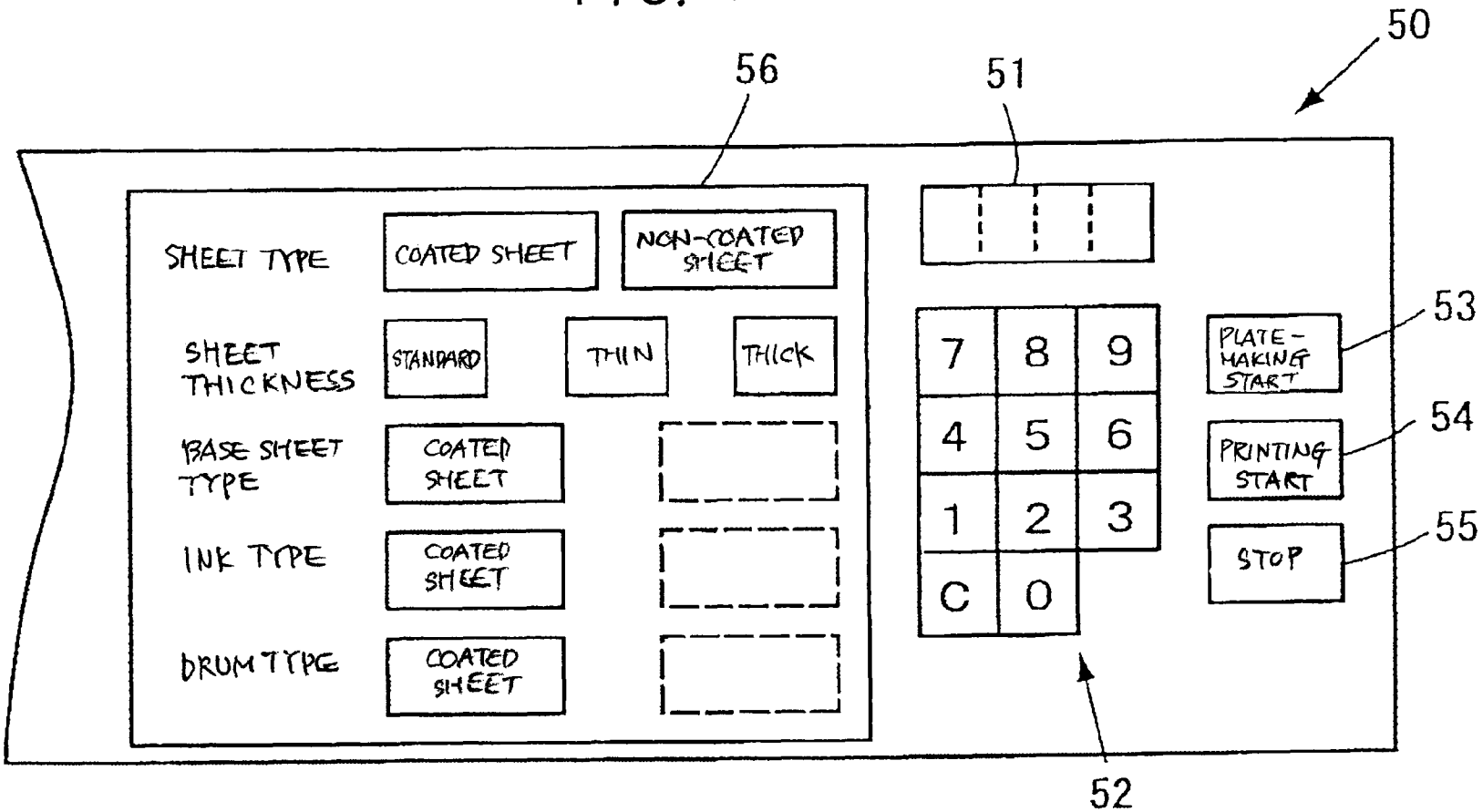
FIG. 4 is a plan view of a portion of an operating panel of the stencil printing apparatus.

FIG. 4 shows part of an operating panel portion of the aforementioned stencil printing apparatus. The operating panel 50 comprises a print set number display portion 51, a ten-key numeric keypad 52, a platemaking start key 53, a print start key 54, a stop key 55 and a liquid crystal display portion 56.

The liquid crystal display portion 56 is constituted by touch keys and is designed to facilitate input based on a part thereof being pressed in response to a display. As shown in the diagram, in a standard operation display, the sheet type is initially designated. Accordingly, the liquid crystal display portion 56 constitutes sheet-type input means by which discrimination of whether the printing sheet set in the sheet-feed device is a coated sheet or a non-coated sheet is input.

The sheet type is initially input as either a "coated sheet" or a "non-coated sheet", and is further selectively designated as "standard sheet", "thin sheet" or "thick sheet".

Because the image can be fixed with UV rays employing a UV-ray-curable ink in the stencil printing apparatus pertaining to this embodiment, not only a conventional "non-coated sheet" but also a "coated sheet" can be used as the printing sheet.

A control device 57 (FIG. 5) of the stencil printing apparatus judges the type of mounted master roll on the basis of information detected from base sheet type detection means 48, and displays whether this is "for coated sheet printing" or "for non-coated sheet printing" in the liquid crystal display portion 56. As a result, an operator can confirm the master type.

Similarly, it judges the type of mounted on the container 39 on the basis of information detected from ink container-type detection means 40 and displays whether this is "for coated sheet printing" or "for non-coated sheet printing" in the liquid crystal display portion 56.

In addition, it judges the type of mounted drum unit on the basis of information detected from drum unit type detection means 43 and displays whether this is "for coated sheet printing" or "for non-coated sheet printing" in the liquid crystal display portion 56.

When a "coated sheet" is designated by input as the sheet type and any one of the mounted master scroll type, ink container-type or drum unit type are detected as being for non-coated sheet printing, the control device issues a warning to the liquid crystal display portion 56 such as, for example, "please confirm the ink container-type" and executes a control that invalidates the platemaking start key 53 or the print start key 54.

Similarly, when a "non-coated sheet" is designated by input as the printed sheet type and any one of the mounted master scroll type, ink container-type or drum unit type are detected as being for coated sheet printing, the control device issues a warning to the liquid crystal display portion 56 such as, for example, "please confirm the drum unit type" and executes a control that invalidates the platemaking start key 53 or the print start key 54.

Basically, if the type of master scroll is not compatible with the sheet type, the platemaking start key 53 is invalidated, and when one or both of the type of ink container 39 and the type of drum unit are not compatible with the sheet type, the print start key 54 is invalidated.

Figure 5:
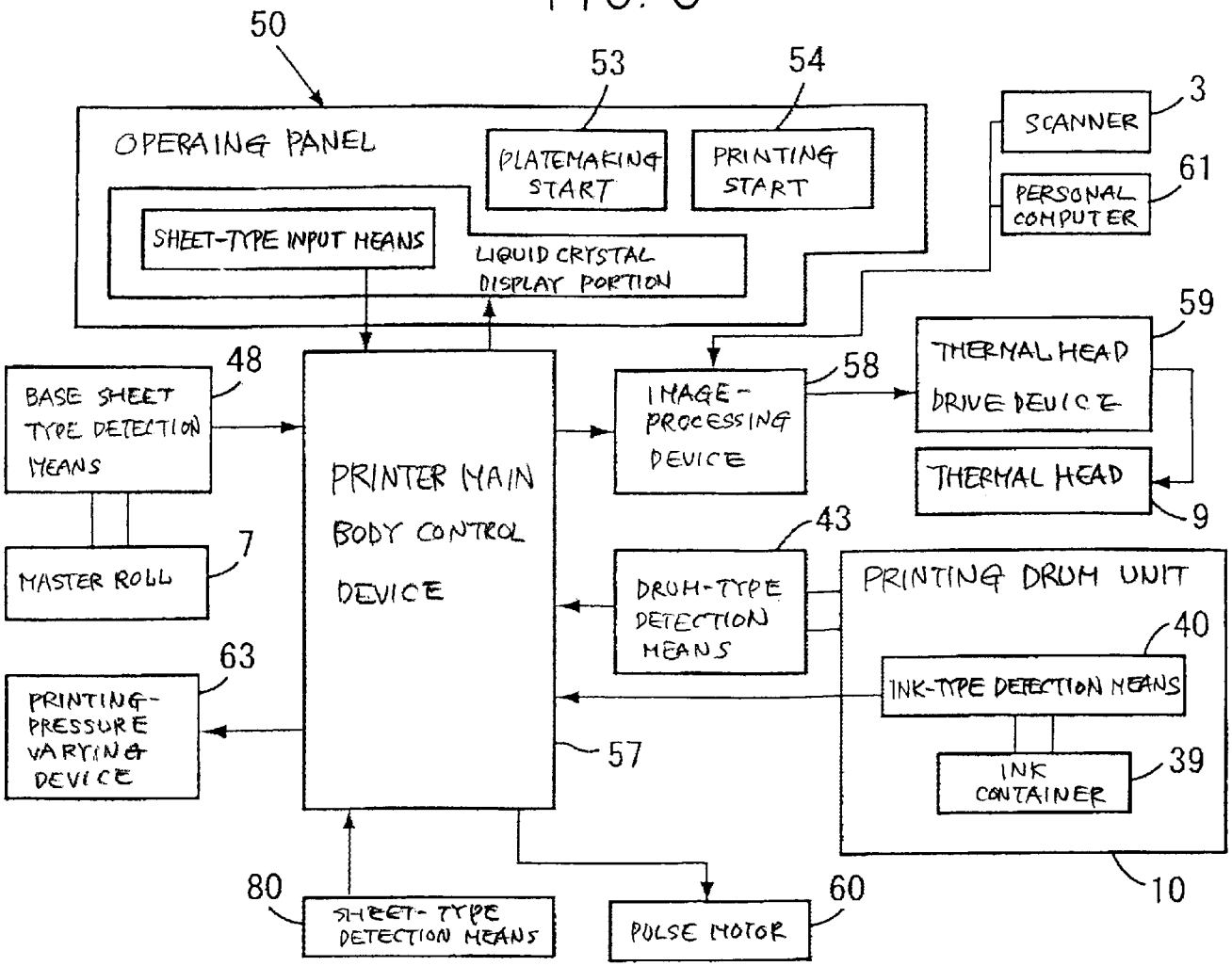
FIG. 5 is a block diagram of a configuration of a control system of the stencil printing apparatus.

FIG. 5 shows the configuration of a control system of the aforementioned stencil printing apparatus. The symbol 57 denotes a control device of the stencil printing apparatus. The symbol 58 denotes an image processing portion for executing various types of image processing subsequent to original image data information sent from the scanner 3 or a personal computer 61 into which the original has been read being received, a digital image signal of the image-processed result being sent to a thermal head drive device 59.

The thermal head drive device 59 selectively drives a thermal head 9 causing it to generate heat, a resin film of the master being thermally perforated as a result in accordance with the image information. Simultaneously, the control device 57 controls the drive of a pulse motor 60 for driving the platen roller 8 which conveyably drives the master in such a way as to control the perforation speed in the direction of conveyance.

The perforations are optimally created in the master 7 in this way. It is clear from the conventional art that, within a certain range in stencil printing apparatuses, the larger the diameter of the platemaking perforations the greater the amount of ink transferred onto the printing sheet.

The voltage application time to the thermal head 9 is set larger (for example, 1.2 to 1.5 times) for a coated sheet than for a non-coated sheet. Accordingly, while the extent of ink permeation and diffusion achieved with non-coated sheet cannot be anticipated in platemaking in which the diameter of the perforations is made larger for coated sheet printing using a high platemaking energy, a high density image can be produced.

Variable adjustment of the platemaking energy is afforded in actual practice by varying the output pulse width to the thermal head 9. Enlarging the output pulse width to the thermal head 9 results in increased voltage application time and an increase in the time taken for the temperature of the heat-emitting body to drop and, accordingly, to some extent it is necessary to slow the feed speed of the master. During printing on a coated sheet, the required platemaking time is increased slightly to ensure reliable image formation.

The stencil printing apparatus pertaining to this embodiment further comprises a printing pressure varying device (printing pressure device) 63 for varying the pressing force at which the press roller 28 presses the printing sheet onto the plate cylinder 37 to effect image formation. A pulse motor for varying the tension of a printing pressure spring not shown in the diagram for pressing the press roller 28 onto the plate cylinder 37 and a sensor for sensing the tension position of the printing pressure spring, and a predetermined pressure force is able to be set.

It is clear from the conventional art that, within a certain range in stencil printing apparatuses, the greater the printing pressure the greater the amount of ink transferred onto the printing sheet.

Figure 6:
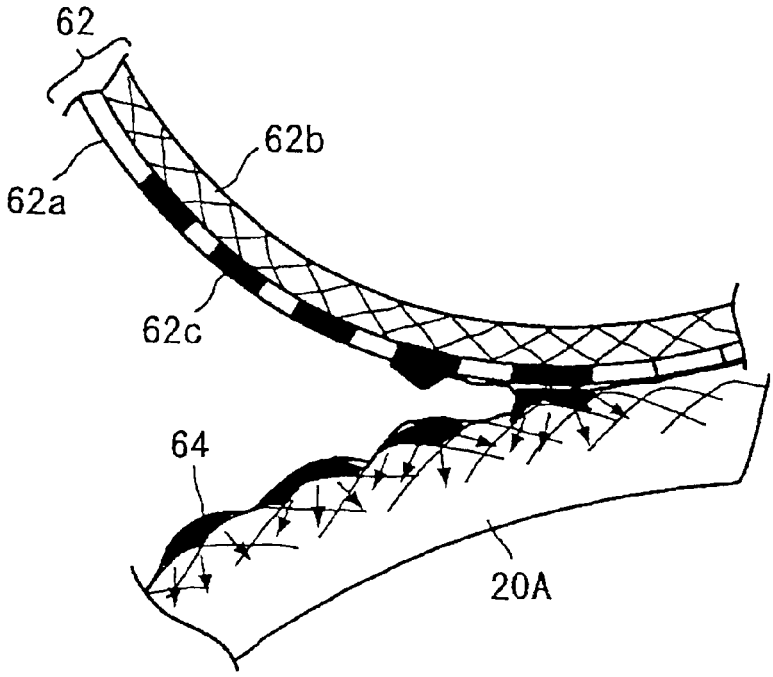
FIG. 6 is a highly magnified sketch diagram of a cross-section of a printed portion when printing is performed on a normal printing sheet.

FIG. 6 shows a cross-section of a printed portion of normal sheet on which printing has been performed using the stencil printing apparatus pertaining to this embodiment. Here, the symbol 62 denotes a master mounted and fixed to the outer circumferential surface of the plate cylinder 37, the symbol 62*a* denotes a film, and the symbol 62*b* denotes a porous supporting body configured from Japanese paper.

A large number of perforations 62*c* are provided in the film 62*a*, the ink passing therethrough being transferred onto the surface of a printing sheet 20A forming an ink-adhered portion 64. Here, the printing sheet 20A is a normal sheet and, accordingly, the adhered ink rapidly permeates into the interior of the sheet and diffuses laterally over the surface thereof. The fibers of normal sheet are directly exposed on the surface thereof and it has large undulations.

While the plate cylinder 37 was rotated in the direction of the arrow and the printing sheet 20A was separated immediately following printing as shown in the diagram, the stickiness of the ink used for normal sheet at this time was comparatively low and the sheet was able to be readily peeled away with a comparatively small force.

Figure 7:
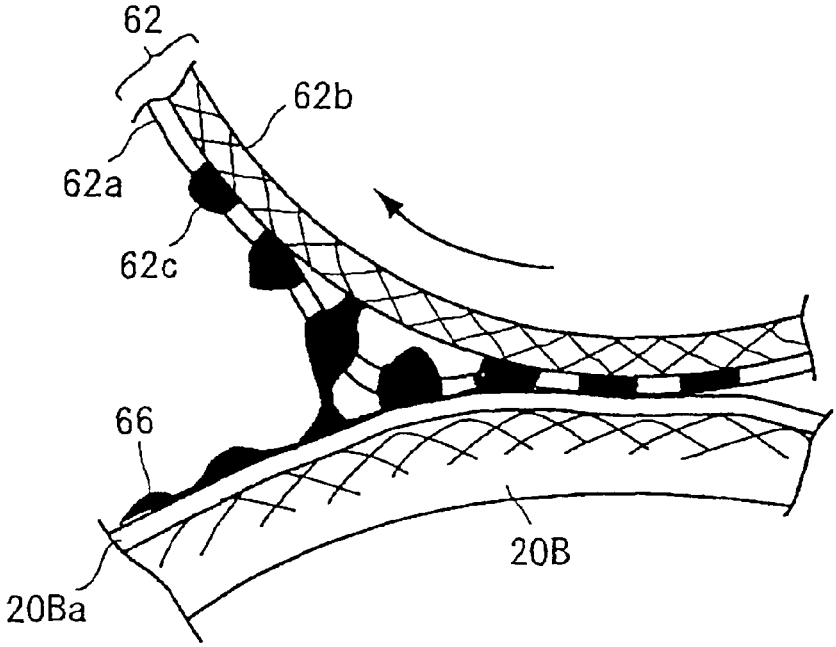
FIG. 7 is a highly magnified sketch diagram of a cross-section of a printed portion when printing is performed on a coated sheet.

FIG. 7 shows a cross-section of a printed portion of coated sheet on which printing was performed using the stencil printing apparatus pertaining to this embodiment. Here, the symbol 62 denotes a master windingly mounted on the outer circumferential surface of the plate cylinder 37, the symbol 62*a* denotes a film, and the symbol 62*b* denotes a porous supporting body configured from Japanese paper. A large number of perforations 62*c* are provided in the film 62*a*, the ink passing therethrough being transferred onto the surface of a coated sheet 20B to form an ink-adhered portion 66.

Here, the coated sheet 20B comprises on its surface a very smooth coated layer 20Ba and, accordingly, the permeation of the affixed ink into the interior of the sheet was negligible, and there was almost no diffusion of ink occurring laterally over the surface thereof.

A mutually smooth state between the surface of the film 62*a* of the master and the surface of the coated sheet 20B was produced, and a perfect closely adhered state was established in a state in which a high-viscosity ink was interposed therebetween.

While the plate cylinder 37 was rotated in the direction of the arrow and the coated sheet 20B is forcibly separated immediately following printing as shown in the diagram, naturally, the peeling force actioned at this time was comparatively larger than that used for normal sheet. As a result, the occurrence of a phenomenon in which the film 62*a* of the master is pulled due to strong adhesion as shown in the diagram and caused to separate and lift from the supporting body 62*b* was confirmed.

Subsequently, the film 62*a* became elongated and saggy with creases being formed therein as a result. In addition, the inability of the film 62*a* to withstand further stretching in this way during peeling immediately following printing and, in the end, the film 62*a* being torn was confirmed.

While a cause thereof resides in the surface smoothness of the coated sheet 20B, other causes reside in the viscosity of the ink itself and the insufficient strength of the film of the master.

As a result of an examination carried out to determine measures for resolving the drawbacks described above, the inventor of the present invention confirmed that the master and the ink used for normal sheet are unsuitable for printing on a coated sheet of high surface smoothness and, in turn, discovered the need for a special master and printing ink for coated sheet printing and for a method to be devised for the employment of the same.

It was apparent that a special master for coated sheet printing must possess a film of strong strength, and a strong adhesion force with the supporting body. More specifically, it was apparent that the thickness of the film must be increased while altering the material quality grade thereof.

In addition, it was apparent that the adhesive coating must be changed and the quantity of coated adhesive increased. However, it was apparent because of the drop in the perforation platemaking characteristics of the thermal head 9 that occurred in this case, the supplied energy must be increased and the speed of conveyance during platemaking reduced.

In addition, it was apparent that the special printing ink for coated sheet printing must possess a low adhesion force and have a small tack value. More specifically, it was apparent that the viscosity of the ink must be lowered and the material quality of the high viscosity component altered.

In addition, it was apparent that increasing the printing pressure during printing was inadvisable and, in turn, it was apparent that there was a need to produce an ink capable of readily affixing to a coated sheet in the absence of a high printing pressure. For ease of understanding thereof, this is shown in FIG. 11.

Figure 8A:
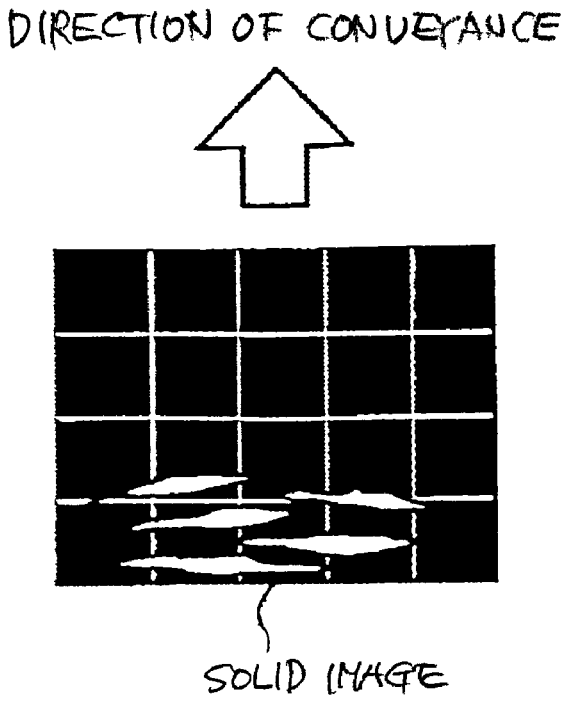
FIGS. 8A and 8B are diagrams showing examples of image quality defects in a solid image portion when printing is performed on a coated sheet employing a master and printing ink for normal sheet printing.
Figure 8B:
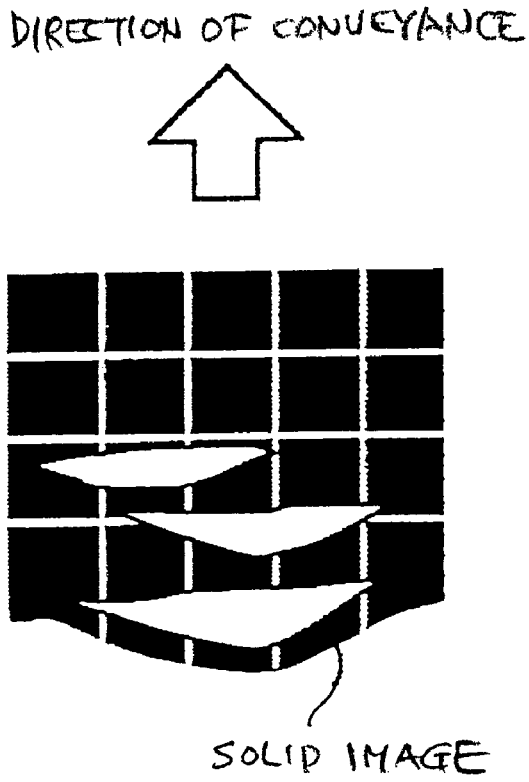

FIGS. 8A and 8B show examples of the image quality defects in a solid image portion printed on coated sheet using the stencil printing apparatus pertaining to this embodiment employing a master and printing ink for normal sheet printing.

FIG. 8A shows a printed image state during square solid image printing in which white spots are generated due to creasing in part of the master film. FIG. 8B similarly shows a printed image state during square solid image printing subsequent to tear having occurred in a part of the master film.

FIG. 12 show the relationship between the master strength and ink viscosity for coated sheet and non-coated sheet as confirmed through testing.

Figure 9:
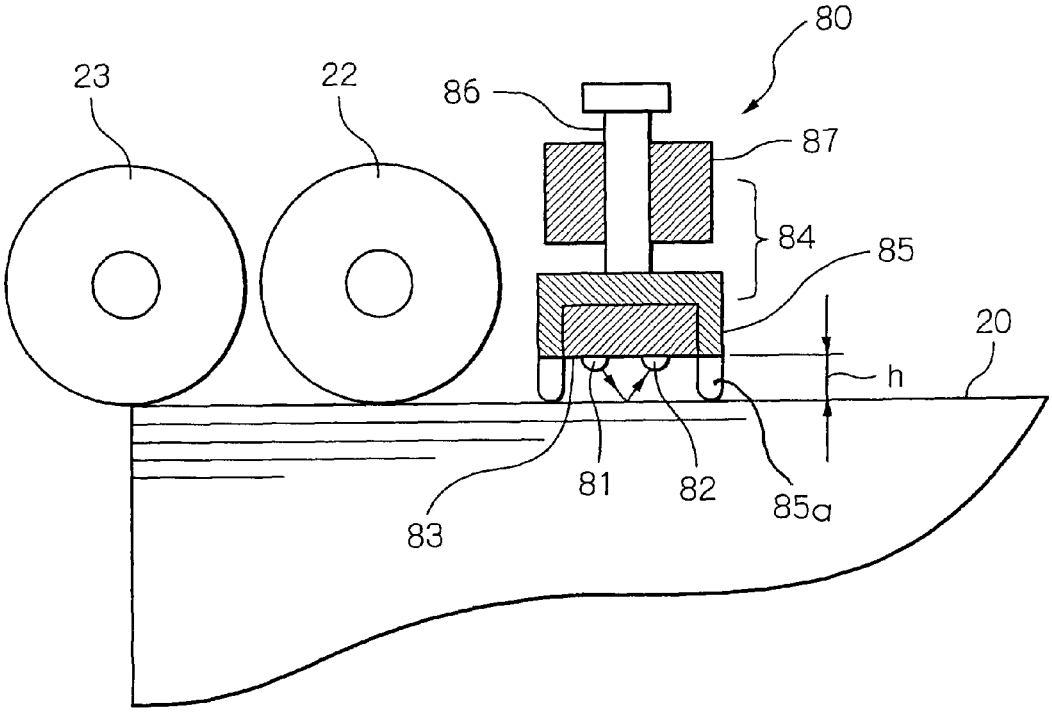
FIG. 9 is a partial cross-sectional view showing a usage state of sheet detection means.

FIG. 9 is a schematic diagram of sheet-type detection means for automatically detecting whether or not the printing sheet set in the sheet-feed device is a coated sheet or a non-coated sheet.

Sheet-type detection means 80 comprises a sensing portion 83 that integrally comprises a photo-emitting element 81 and a photo-receiving element 82, and a holding body 84 for substantially fixedly maintaining the distance between the sensing portion 83 and the upper surface of a printing sheet 20 in a sheet-feedable state.

The holding body 84 comprises a cross-sectional U-shaped or tubular-shaped holder 85 for encloseably supporting the sensing portion 83, a slide shaft 86 fixed to the upper surface of the holder 85 and extending in the vertical direction, and a positionally-fixed slide guide 87 for guiding the slide shaft 86.

While the slide shaft 86 is guided by the slide guide 87 with freedom in the vertical direction, it lowers gravitationally.

Subsequent to the printing sheet 20 being set in the sheet-feed tray 21 and the platemaking start key 53 being pushed, the sheet-feed tray 21 rises before being stopped at a predetermined position sensed by an upper-limit position sensing sensor not shown in the drawing. Sheet-type detection means 80 identifies whether this printing sheet is coated sheet or non-coated sheet by detecting the optical reflectance of the upper surface of the uppermost printing sheet.

When the sheet-feed tray 21 rises, the upper surface of the uppermost printing sheet abuts a leg portion 85*a* of the holder 85, a distance h between the upper surface of the printing sheet and the sensing portion 83 being able to be always accurately ensured. If the reflected light from the upper surface of the printing sheet of the light emitted by the photo-emitting element 81 is detected by the photo-receiving element 82 and this reflectance constitutes a value above a set threshold value (includes a conversion value to a voltage value or the like), control means 60 confirms (judges) the printing sheet as being a coated sheet on the basis of a signal thereof and, if less than the threshold value, confirms the printing sheet as being a non-coated sheet.

Figure 10A:
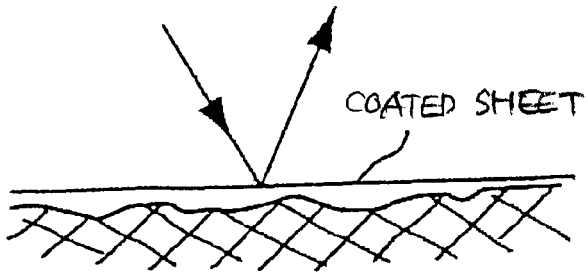
FIGS. 10A and 10B are schematic diagrams of the reflectance from the upper surfaces of printing sheets, FIG. 10A showing the reflectance from a coated sheet and FIG. 10B showing the reflectance from a non-coated sheet.
Figure 10B:
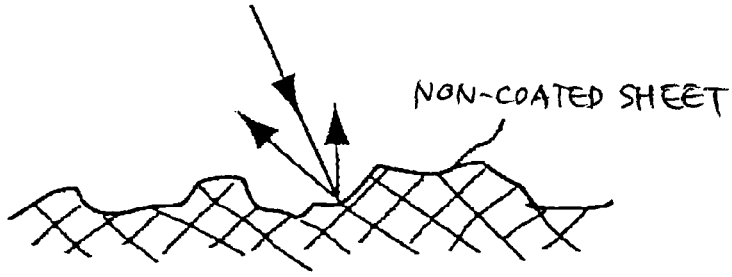

As shown in FIG. 10A, because the surface of a coated sheet is smooth and the sheet fibers thereof are coated with a white color-based material, it has a high reflectance because it. On the other hand, as shown in FIG. 10B, because the surface of a non-coated sheet (normal sheet) is composed of fibers and comprises severe undulations, diffuse reflection resulting in lowered optical reflectance occurs therefrom.

Another example of a well-known method for identifying whether the printing sheet is a coated sheet or a non-coated sheet is a method for detecting surface roughness.

Identification of the printing sheet as a coated sheet or a non-coated sheet is possible in a configuration comprising one of either the aforementioned liquid crystal display portion 56 or sheet-type detection means 80, or in a configuration comprising both in which the information from either one may be prioritized. For example, in a configuration comprising both a liquid crystal display portion 56 and sheet-type detection means 80, the control device 57 judges whether or not the printing sheet is a coated sheet on the basis of detected information from sheet-type detection means 80 rather than from sheet-type input means.

Excluding the characterizing elements of the present invention as described above, the remaining elements of the printing operation are identical to those of the conventional art and, accordingly, a description thereof has been omitted.

When stencil printing is performed on a coated sheet of high surface smoothness according to the present invention, the drawback caused by a lack of resistance of the stencil base sheet film that results in premature slip thereof and the formation of creases and tear can be reliably prevented. This is possible because a special high-strength sheet for coated sheet printing is used, this sheet ensuring prevention of the trouble generated when a conventional stencil base sheet is erroneously used.

In addition, increasing the adherence force between the printing sheet and the coated sheet ensures prevention of sheet discharge trouble generated as a result of unreliable sheet discharge peeling. This is possible because a special low cohesion ink for coated sheet printing is used, this ink ensuring prevention of the trouble generated when a conventional stencil printing ink is erroneously used.

In addition, the use of a special low cohesion ink printing drum unit for coated sheet printing and the increase in the adherence force between the stencil base sheet and the coated sheet ensure prevention of sheet discharge trouble caused by unreliable sheet discharge peeling, this drum unit ensuring prevention of the trouble generated when a conventional stencil printing ink drum unit is erroneously used.

Various modifications will become possible for those skilled in the art after receiving the teachings of the present disclosure without departing from the scope thereof.

What is claimed is:

1. A stencil printing apparatus having a platemaking device that creates perforations in a stencil base sheet via platemaking means, a rotationally-driven cylindrical plate cylinder on an outer circumferential surface of which a stencil base sheet made by platemaking is mounted, a sheet-feed device for separately feeding out a printing sheet, a printing-pressure device for pressing a fed printing sheet onto the outer circumferential surface of the plate cylinder, and a sheet discharge device for conveying and discharging a printed sheet, the stencil printing apparatus, comprising:

a sheet-type detecting unit which automatically detects whether a printing sheet set in the sheet-feed device is a coated sheet or a non-coated sheet;

base-sheet type detection means for detecting a type of the stencil base sheet set in the platemaking device; and a control device for, when a sheet type detected via the sheet-type detecting unit is a coated sheet, executing a control for judging whether or not a type of stencil base sheet set in the platemaking device is for coated sheet printing on the basis of a detected signal from the sheet-type detecting unit, and permitting platemaking start when the stencil base sheet type is for coated sheet printing and issuing a warning without permitting platemaking start when the stencil base sheet type is for non-coated sheet printing, wherein the sheet-type detecting unit detects whether the printing sheet set in the sheet-feed device is a coated sheet or a non-coated sheet based on an optical reflectance of the printing sheet, and wherein a film thickness of the coated sheet as a printing sheet is larger than a film thickness of the non-coated sheet, and an adhesive of the coated sheet is stronger than an adhesive of the non-coated sheet.

2. The stencil printing apparatus as claimed in claim 1, wherein the sheet-type detecting unit includes a sensing portion with a photo-emitting element and a photo-receiving element.

3. The stencil printing apparatus as claimed in claim 2, wherein the sheet-type detecting unit includes a holding body which fixedly maintains a predetermined distance between the sensing portion and the printing sheet set in the sheet-feed device.

4. The stencil printing apparatus as claimed in claim 3, wherein the holding body includes a U-shaped or tubular-shaped holder which encloseably supports the sensing portion.

5. The stencil printing apparatus as claimed in claim 4, wherein the holder includes a leg portion which abuts the printing sheet set in the sheet-feed device.

* * * * *